US012123688B2

(12) United States Patent
Keller et al.

(10) Patent No.: US 12,123,688 B2
(45) Date of Patent: Oct. 22, 2024

(54) PENETRATOR, USE OF A PENETRATOR, AND PROJECTILE

(71) Applicant: Rheinmetall Waffe Munition GmbH, Südheide (DE)

(72) Inventors: Ulrich Keller, Unterlüß (DE); Konstantin Arzt, Adelheidsdorf (DE); Michael Gowin, Hermannsburg (DE); Martin Berg, Unterlüß (DE); Jan-Erik Melskotte, Unterlüß (DE)

(73) Assignee: Rheinmetall Waffe Munition GmbH, Südheide (DE)

( * ) Notice: Subject to any disclaimer, the term of this patent is extended or adjusted under 35 U.S.C. 154(b) by 49 days.

(21) Appl. No.: 18/163,468

(22) Filed: Feb. 2, 2023

(65) Prior Publication Data

US 2023/0204332 A1 Jun. 29, 2023

Related U.S. Application Data

(63) Continuation of application No. PCT/EP2021/068591, filed on Jul. 6, 2021.

(30) Foreign Application Priority Data

Aug. 6, 2020 (DE) ..... 10 2020 120 747.6

(51) Int. Cl.
*F42B 14/06* (2006.01)
*F42B 10/04* (2006.01)
*F42B 12/06* (2006.01)

(52) U.S. Cl.
CPC ..... *F42B 12/06* (2013.01); *F42B 10/04* (2013.01); *F42B 14/06* (2013.01)

(58) Field of Classification Search
CPC ..... F42B 14/06; F42B 14/061; F42B 10/06; F42B 12/06
See application file for complete search history.

(56) References Cited

U.S. PATENT DOCUMENTS

| | | | |
|---|---|---|---|
| 5,297,492 A | 3/1994 | Buc | |
| 2020/0173761 A1 | 6/2020 | Vabnick | |
| 2022/0252382 A1 * | 8/2022 | Barrett | F42B 10/30 |

FOREIGN PATENT DOCUMENTS

| | | |
|---|---|---|
| DE | 30 38 087 A1 | 5/1982 |
| DE | 37 35 737 A1 | 5/1989 |
| DE | 37 36 167 A1 | 5/1989 |
| DE | 39 10 593 A1 | 10/1990 |
| DE | 39 32 952 A1 | 4/1991 |
| DE | 40 22 821 A1 | 1/1992 |
| DE | 39 40 969 C2 | 1/1995 |

(Continued)

OTHER PUBLICATIONS

International Search Report from corresponding PCT Application No. PCT/EP2021/068591, dated Oct. 8, 2021.

(Continued)

*Primary Examiner* — J. Woodrow Eldred
(74) *Attorney, Agent, or Firm* — Harness, Dickey & Pierce, P.L.C.

(57) ABSTRACT

The invention relates to a penetrator (1) for a projectile having a tail unit, in particular a subcaliber kinetic energy projectile, comprising a main body (10), the main body (10) having at least one partial region (12, 12', 12") with longitudinal recesses (20, 20, 20").

17 Claims, 5 Drawing Sheets

(56) References Cited

FOREIGN PATENT DOCUMENTS

| | | | |
|---|---|---|---|
| DE | 20 2013 101 559 | U1 | 6/2013 |
| DE | 10 2015 117 018 | A1 | 4/2017 |
| DE | 10 2019 113 325 | A1 | 11/2020 |
| DE | 10 2019 126 604 | A1 | 4/2021 |
| DE | 10 2020 104 217 | A1 | 8/2021 |
| EP | 0 143 775 | A2 | 6/1985 |
| EP | 2 597 416 | A2 | 5/2013 |
| EP | 2 372 295 | B1 | 10/2013 |
| FR | 2 711 786 | A1 | 5/1995 |

OTHER PUBLICATIONS

Written Opinion from corresponding PCT Application No. PCT/EP2021/068591, dated Oct. 8, 2021.
Office Action from corresponding German Patent Application No. 10 2020 120 747.6, dated Mar. 15, 2021.

* cited by examiner

PENETRATOR, USE OF A PENETRATOR, AND PROJECTILE

CROSS-REFERENCE TO RELATED APPLICATIONS

This application is a continuation application of PCT Application No. PCT/EP2021/068591, filed on 6 Jul. 2021, which claims priority to and benefit of German Patent Application No. 10 2020 120 747.6, filed on 6 Aug. 2020. The entire disclosures of the applications identified in this paragraph are incorporated herein by references.

FIELD

The invention relates to a penetrator for a projectile having a tail unit, in particular a subcaliber kinetic energy projectile, comprising a main body.

Furthermore, the invention relates to the use of such a penetrator.

Additionally, the invention relates to a projectile with a sabot and a tail unit, comprising such a penetrator.

BACKGROUND

A penetrator is part of a projectile that penetrates armor by its kinetic energy alone. In principle, it is favorable for penetrating armor if a penetrator comprises a strength and density that is significantly higher than the respective values of the armor material. Furthermore, the penetrator should comprise the highest possible projectile mass and velocity.

A variant of this type of projectile is the so-called APFSDS ammunition, in which the penetrator has a basic cylindrical shape. Due to the shape, which is characterized in particular by a large length-to-diameter ratio, its stabilization is achieved by an aerodynamically acting tail unit. For firing from a powder gun, a sabot is also required, which seals and guides the penetrator during the passage through the barrel.

Penetrators are usually made of high-density and high-strength material such as tungsten carbide, tungsten sintered metal or similar high-density materials.

The high penetration performance of this type of penetrator comes from the fact that its kinetic energy acts on the smallest possible area, namely the front surface of the cylindrical main body or the tip or head of the penetrator. When penetrating the armor, the main body is eroded starting from its head/tip. The greater the length of the penetrator, the greater the penetration depths it achieves with homogeneous armor, e.g. armor steel plates (semi-infinite targets).

Modern armor, however, has a non-homogeneous structure, which takes the form of multilayer armor made of different materials and/or bulkhead armor (spaced armor). In addition, attempts are made to design the armor angled in the direction of flight/impact of the penetrator.

All these measures are aimed at generating load components at the armor lateral to the direction of travel, which are capable of deflecting long and thin projectiles laterally or breaking them up. This significantly reduces penetration performance. Also heavy reactive armor takes advantage of the principle of lateral disturbance.

As a result, high length-to-diameter ratios find an upper limit. This upper limit is reached when the diameter of the penetrator is so small that, as a result of its then low moment of resistance to bending by the lateral disturbance, it no longer offers sufficiently high resistance. From this, a minimum diameter of the penetrator for a given target can be determined.

An increase in diameter, even if it is only local or variable over the length of the projectile, e.g. in the form of a cone, always results in a quadratic increase in cross-sectional area in addition to the increase in moment of resistance. This is very unfavorable in terms of the increase in mass of the projectile and the focusing of the projectile energy.

Efficient penetration of the armor requires high projectile velocities. Since a powder gun provides only a certain amount of energy, the maximum penetrator mass is also delimited at a defined projectile velocity.

With a cylindrical shape, this determines the optimum penetrator length. Increasing the penetration performance is conventionally only possible by increasing the projectile energy (by choosing a larger caliber).

From the document EP 2 372 295 B1 a penetrator with a stepped profile is known, which comprises a bore in the interior, which extends along the two stepped parts of the penetrator, wherein an explosive charge is arranged in the interior of the bore and the wall of the penetrator is configured over this area with substantially the same thickness. This penetrator is not suitable for engaging a battle tank with reactive armor, but is used to penetrate a thin wall and cause an explosion with the greatest possible fragmentation effect. This is due to the fact that the penetrator does not comprise a massive main body.

The document DE 40 22 821 A1 discloses a subcaliber kinetic energy projectile that comprises a large length-to-diameter ratio and is intended to penetrate targets with multiple armor. To ensure this, a predetermined breaking point is located in the area of the tip so that the tip can break off. This type of projectile is designed to engage multi-plate targets.

From the document DE 10 2015 117 018 A1, a multi-part penetrator is known which comprises an interface to which different penetrator tips can be attached. The different penetrator tips are adapted to the respective use.

Document EP 2 597 416 A2 also discloses a multi-part penetrator with an attached penetrator tip.

In addition, ways have been sought in the past to provide penetrators that are specifically suitable for engaging multi-plate targets, such as in the as-yet unpublished application DE 10 2019 113 325.4. The concept proposed there involves configuring the tip of the penetrator to be thinner and, in this way, achieving conservative weight optimization of the tip of the penetrator.

Penetrators are also known from the prior art that comprise circumferential radial grooves as a connecting element, which serve to connect a sabot to the main body of the penetrator. Such penetrators are known, for example, from DE 37 35 737 A1.

Furthermore, penetrators are known from DE 37 36 167 A1 with a circumferential screw profile on which the sabot of the penetrator is arranged, which is automatically released during the flight of the penetrator due to the screw shape.

Furthermore, penetrators are known from the prior art which have grooves arranged in the tail area of the main body to accommodate individual wings of a tail unit. Such penetrators are known, for example, from DE 30 38 087 A1. However, the aim of such penetrators is not to provide an increased section modulus.

Furthermore, there have already been attempts in the past to increase the section modulus of penetrators by attaching additional stiffening plates to the sides of the penetrators. However, these additional stiffening elements have no end ballistic effect and reduce the proportion of the end ballistic mass of the penetrator in relation to the total weight of the penetrator. Such a penetrator is known from DE 39 32 952 A1.

Based on this, the object of the invention is to provide a penetrator with increased penetration performance against a target that causes significant lateral interference without increasing penetrator mass.

This object is accomplished by the features of claim 1. Advantageous embodiments and further modifications are subject of the dependent claims.

According to the invention, a penetrator is provided for a projectile with a tail unit, in particular a subcaliber kinetic energy projectile. The penetrator comprises a main body. The main body comprises at least one partial region with longitudinal recesses.

The longitudinal recesses according to the invention serve to provide a main body in which at least one partial region with longitudinal recesses comprises an increased section modulus, compared to a penetrator with a cross-section having a circular surface of equal area.

These longitudinal recesses of the main body in accordance with the invention are not used to accommodate tail elements or other elements (such as stiffening elements) of a projectile. Rather, the longitudinal recesses are free spaces that are left empty to reduce the weight of the penetrator.

Preferably, the shape of the longitudinal recesses is such that they are not configured to receive tail elements or other elements.

According to the invention, a penetrator is provided which comprises a higher surface moment of inertia with the same material input as a conventional (essentially cylindrical) penetrator.

Further provided in accordance with the invention is a use of such a penetrator, or penetrators modified as described below, for engaging an armored target having reactive armor, in particular a tank having reactive armor.

Further, according to the invention, a projectile having a sabot and a tail unit comprising such penetrator or penetrator modified as described below is provided.

The invention relates to the optimized main body of the penetrator. The invention is based on the fact that cross-sectional elements of the main body of the penetrator are arranged as far as possible outside the longitudinal axis of the main body (this longitudinal axis is also the longitudinal axis of the penetrator). This produces an increased area moment of inertia (section modulus) compared to a circular shape of the same cross-sectional area. To keep the increase in cross-section and thus the increase in mass within limits, the increase in cross-section is not implemented over the entire circumference, but longitudinal recesses are provided in the main body. If the shape is as small as possible (many longitudinal recesses), the initial positioning mentioned at the beginning no longer has a significant effect.

According to the invention, it is also achieved that the outer body of the penetrator comprises an increased bending stiffness compared to a series penetrator, such as the DM53 or the DM63 of the applicant, with a solid main body of the same cross-sectional area in the at least one partial region, without having to increase the weight of the penetrator compared to the series penetrator.

An engagement of an armored target within the meaning of the invention envisages destruction of a primary target.

The area moment of inertia of the main body of a penetrator according to the invention is increased compared to previous penetrators, without increasing the weight of the penetrator and without reducing the kinetic energy introduced into the main target.

SUMMARY

According to the invention, a solution to the above-mentioned conflict of objectives is created in the design of a penetrator by increasing the area moment of inertia while at the same time maintaining the weight, which makes it possible to create a penetrator that is both particularly resistant to bending toward pre-targets and effective in the main target.

Preferably, the cross-section of the partial region with recesses comprises an area A and an area moment of inertia of the cross-section of the partial region with recesses is increased compared to an at least equal area solid cross-section, so that the main body comprises an increased bending stiffness due to the increased area moment of inertia.

In the at least one partial region provided with the longitudinal recesses, the main body of the penetrator comprises a large selected outer diameter having a high section modulus against bending with reduced cross-sectional area and mass compared to a circular cross-section of equal area.

Furthermore, it can be provided that a surface moment of inertia of the penetrator is increased compared with a series penetrator by at least 10%, preferably at least 25%, further preferably 40%, in particular more than 60%, further in particular 90%, with the same or reduced weight. By increasing the area moment of inertia, the bending stiffness is also increased.

In an advantageous embodiment of the penetrator, the main body can comprise a surface moment of inertia greater than 20,000 $mm^4$, preferably greater than 40,000 $mm^4$, further preferably greater than 60,000 $mm^4$, more preferably greater than 80,000 $mm^4$, and a Young's modulus greater than 300,000 $N/mm^2$.

This achieves that the bending stiffness of the outer body is so high that the penetrator is bending insensitive enough to an approaching reactive pre-module of armor to penetrate a main target.

The penetrator can further comprise an attached sub-body such as a head. Further, the attached sub-body can comprise a tip. The attached sub-body, particularly its tip, can be aerodynamically optimized.

The tail unit of the projectile can be connected to the penetrator as in unpublished German Patent Application No. 10 2020 104 217.5, the contents of which are incorporated by reference.

Similarly, a ballistically effective hard core can be provided in the tail unit of the projectile as described in unpublished German Patent Application No. 10 2019 126 604.1, the contents of which are incorporated herein by reference.

The main body can preferably be configured in one piece. In the context of the invention, one-piece means that the main body is not composed of different components, but is a one-piece element.

Since the main body comprises at least one partial region with longitudinal recesses, the mass saved as a result can either be used to increase the diameter of the partial region with longitudinal recesses of the main body or the rear region of the main body can be lengthened. The aim is for the rear section of the main body to develop the greatest possible penetrating force in the main target.

Due to the at least one partial region with recesses in the main body of the penetrator, it is possible to configure an overall projectile lighter, so the projectile can hit the target at a higher velocity with the same launch energy.

By configuring the penetrator according to the invention, it is possible to engage targets having reactive armor.

Furthermore, it is advantageous that the front part of the main body is adjustable to the reactive targets to be engaged.

Preferably, the penetrator is used to engage an armored target, especially a tank with reactive armor.

The longitudinal recesses can be configured in an outer wall of the main body.

Furthermore, it can be provided that the longitudinal recesses are distributed equidistantly over the circumference of the partial region. Thereby a symmetrical main body is defined that allows predictable flight characteristics to be provided.

In further embodiments, it can be provided that the at least one partial region with longitudinal recesses comprises a substantially axially symmetrical cross-section.

Furthermore, it can be provided that the main body always comprises a substantially axially symmetrical cross-section along its length.

It can also be provided that the penetrator always comprises an essentially axially symmetrical cross-section over its length.

An essentially axially symmetrical cross-section is advantageous because otherwise the rotation of the projectile about its own axis during the flight phase is not defined. Without an essentially axially symmetrical cross-section, the projectile would strike the target, which is usually oriented at an angle to its direction of flight, at an arbitrary initial angle.

In an advantageous embodiment of the penetrator, it can be provided that the at least one partial region comprises longitudinal recesses in the form of longitudinal notches.

In an embodiment, the longitudinal grooves can be configured to be rectangular, triangular, u-shaped and/or v-shaped.

Furthermore, it can be provided that the at least one partial region comprises longitudinal recesses in the form of longitudinal grooves.

It can further be provided that the at least one partial region is fluted.

In an embodiment, the main body can comprise a first partial region with longitudinal recesses and a second partial region with longitudinal recesses arranged behind the first partial region with longitudinal recesses.

It can be provided that the main body comprises more than one partial region with longitudinal recesses, wherein it can be provided that the first partial region with longitudinal recesses and the second partial region with longitudinal recesses are configured differently. Accordingly, the shape of the longitudinal recesses, the number of longitudinal recesses and/or the length of the longitudinal recesses of the first partial region with longitudinal recesses can differ from those of the second partial region with longitudinal recesses.

It can be provided that a third partial region, preferably a substantially cylindrical partial region, is arranged between the first partial region with longitudinal recesses and the second partial region with longitudinal recesses.

The third partial region can be used for power transmission with the sabot. For this purpose, it can be configured to be essentially cylindrical. Furthermore, the third partial region can comprise a roughened surface.

"Substantially cylindrical outer contour" in the context of the invention means that such elements comprise a cylindrical shape to the greatest extent possible. However, in particular, an area formed to attach the sabot can also comprise a thread or radial grooves configured thereon or therein to attach a sabot to the main body of the penetrator. These grooves or threads or radial grooves can be configured to attach the sabot of the projectile to the main body of the penetrator.

Furthermore, in embodiments, it can be provided that the first fluted partial region comprises three longitudinal recesses, in particular three longitudinal notches, and/or the rear partial region comprises six longitudinal recesses, in particular six longitudinal notches.

The material of the main body can be tungsten heavy metal, steel, titanium and/or aluminum. In particular, sintered tungsten heavy metal can be used as material.

Tungsten heavy metals are defined, for example, in the ASTM B777-07 material standard.

The base material of the main body can comprise a strength of $O_H$=1700 MPa.

In advantageous embodiments of the penetrator, the length to diameter ratio of the penetrator (L/D) can be in the range of 25 to 30.

BRIEF DESCRIPTION OF THE DRAWINGS

In the following, the invention will be explained by means of embodiments with reference to the drawings. They show.

DETAILED DESCRIPTION

Figure 1:
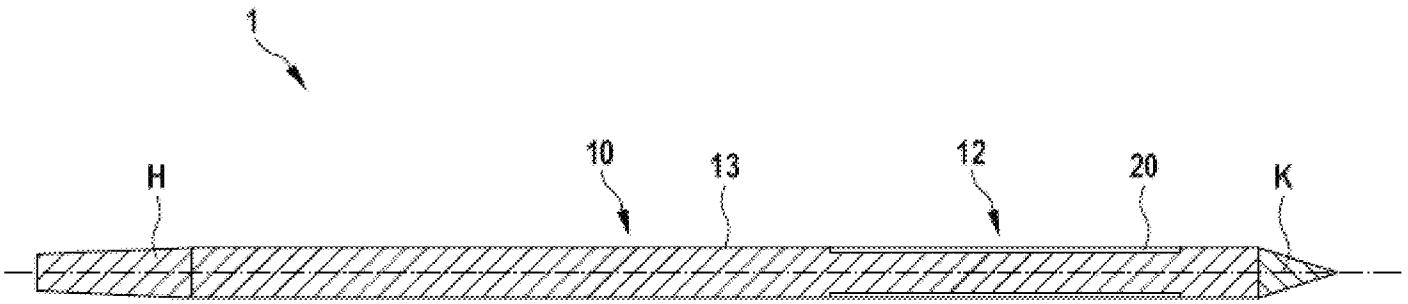
FIG. 1 a schematic representation of a penetrator according to the invention according to a first embodiment.

FIG. 1 shows a schematic perspective view of a first partial region 12 of a main body 10 of a penetrator 1 according to the invention according to a first embodiment. Such a penetrator 1 can be used for engaging an armored target with reactive armor, in particular a tank with reactive armor.

The penetrator 1 is configured for a projectile with a tail unit, in particular a subcaliber kinetic energy projectile.

The penetrator 1 comprises a main body 10. The penetrator further comprises a head K and a tail unit H. The head K and the tail unit H can be configured as part of the main body 10 or attached to the main body 10. Preferably, the main body 10 is configured as a single piece.

Further, the main body 10 comprises at least one partial region 12 that comprises longitudinal recesses 20. The longitudinal recesses 20 are configured in an outer wall 13 of the main body 10.

In the at least one partial region 12 provided with the longitudinal recesses, the main body 10 of the penetrator 1 comprises a large selected outer diameter, which provides a high section modulus against bending with reduced cross-sectional area and mass compared to an equal-area circular cross-section.

The at least one partial region 12 with recesses 20 is configured in such a way that it comprises an increased surface moment of inertia compared to an equal-area circular cross section.

Figure 2:
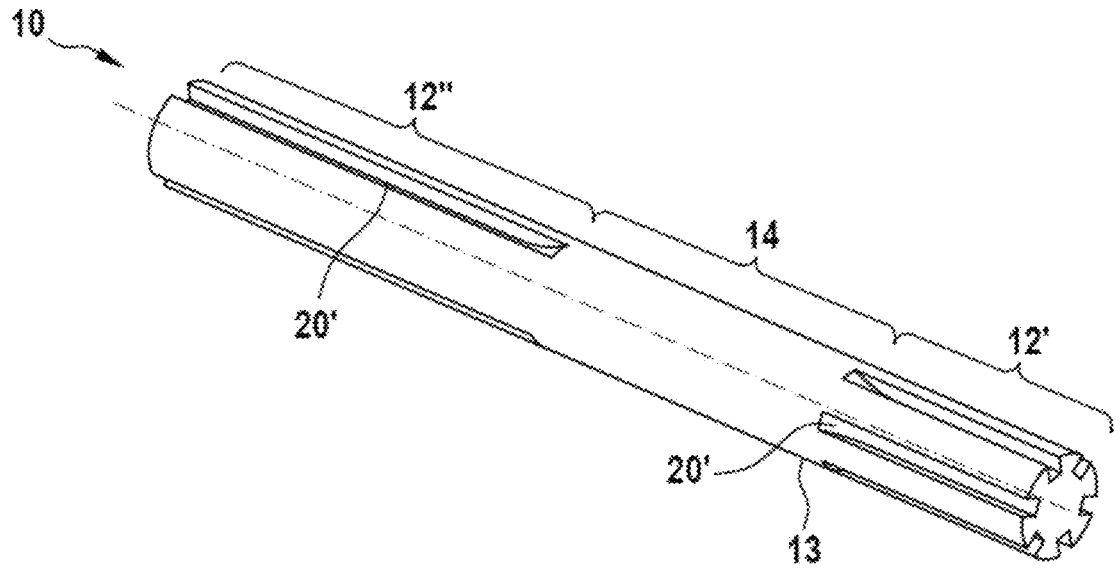
FIG. 2 is a schematic perspective view of a main body of a penetrator according to the invention according to a second embodiment.

FIG. 2 shows a schematic perspective view of a main body 10 of a penetrator 1 according to the invention according to a second embodiment. The second embodiment is based on the first embodiment and only the differences between the first and second embodiment are set forth below.

The main body 10 shown in FIG. 2 comprises a first partial region 12' having longitudinal recesses 20' and a second partial region 12" having longitudinal recesses 20', wherein the second partial region 12" is disposed behind the first partial region 12' having longitudinal recesses 20'.

A third partial region 14 is arranged between the first partial region 12' with longitudinal recesses 20' and the second partial region 12" with longitudinal recesses 20'. This can be a cylindrical partial region 14 as shown in FIG. 2. In the cylindrical partial region 14, there are no longitudinal recesses 20' to ensure power transmission between the penetrator 1 and a sabot.

According to FIG. 2, the first partial region 12' comprises three longitudinal recesses 20, in particular three longitudinal notches 20', and the second partial region 12" comprises six longitudinal recesses 20, in particular six longitudinal notches 20'.

As can be seen from FIG. 2, the longitudinal recesses 20 are distributed equidistantly in the first partial region 12' and in the second partial region 12".

Figure 3:
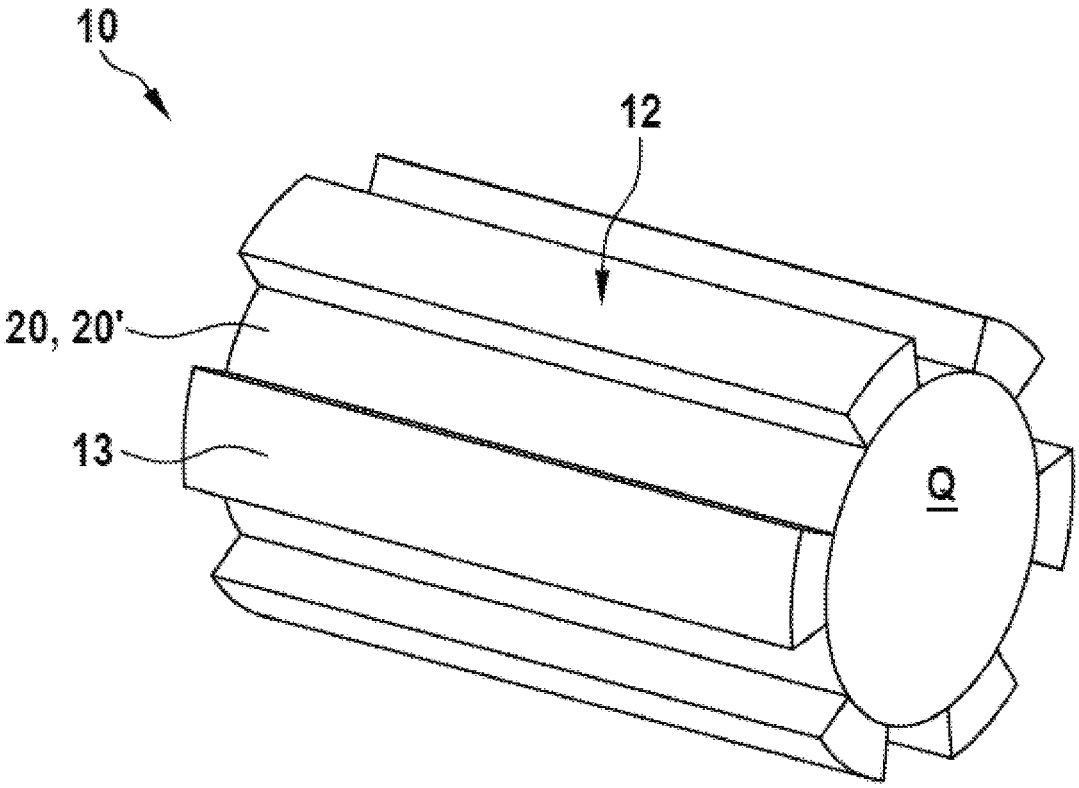
FIG. 3 is a schematic perspective view of a partial region of a main body of a penetrator according to the invention according to a third embodiment.

FIG. 3 shows a schematic perspective view of a main body 10 of a penetrator 1 according to the invention according to a third embodiment. The third embodiment is based on the first and/or second embodiment, and only the differences between the third embodiment and the first and/or second embodiment are set forth below.

As can be seen from FIG. 3, the longitudinal recesses 20' are distributed equidistantly over the circumference of the partial region 12.

The at least one partial region 12 comprises a substantially axisymmetric cross-section Q.

The at least one partial region 12 comprises longitudinal recesses 20 in the form of longitudinal notches 20'. According to FIG. 3, the longitudinal notches 20' are configured in the shape of a rectangle.

Figure 4:
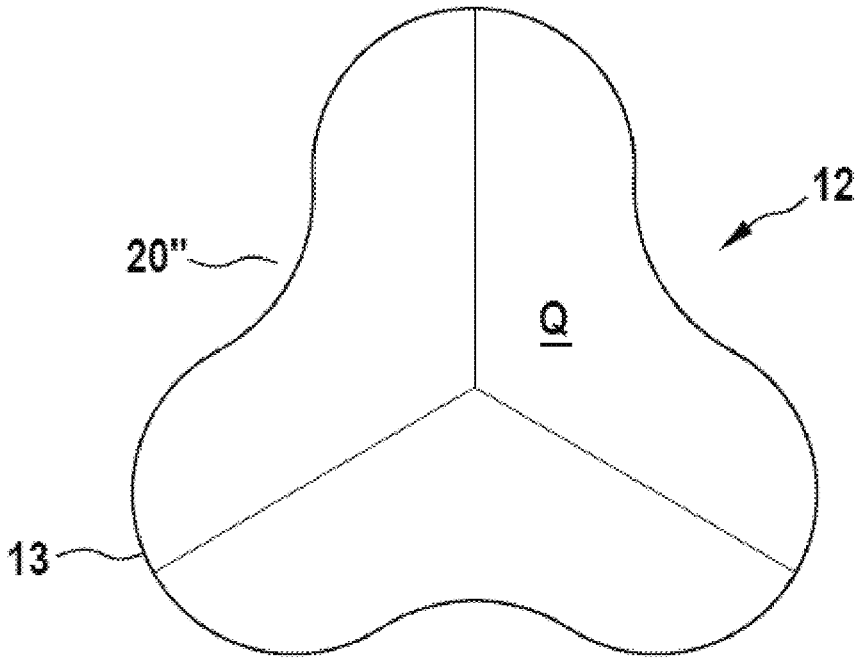
FIG. 4 is a sectional view of a partial region of a main body of a penetrator according to the invention, according to a fourth embodiment.

FIG. 4 shows a sectional view of a partial region 12 of a main body 10 of a penetrator 1 according to the invention, according to a fourth embodiment. The fourth embodiment is based on the first and/or second embodiment, and only the differences between the fourth embodiment and the first and/or second embodiment are set forth below.

The at least one partial region 12 is configured fluted. The longitudinal recesses 20" are rounded and configured concavely in the outer wall of the main body 10 of the penetrator 1.

According to FIG. 4, three longitudinal recesses 20" are shown. However, the number of longitudinal recesses 20 can also be larger.

Likewise, it is possible for the at least one partial region 12 to comprise longitudinal recesses 20, 20', 20" in the form of longitudinal grooves 20".

Figure 5:
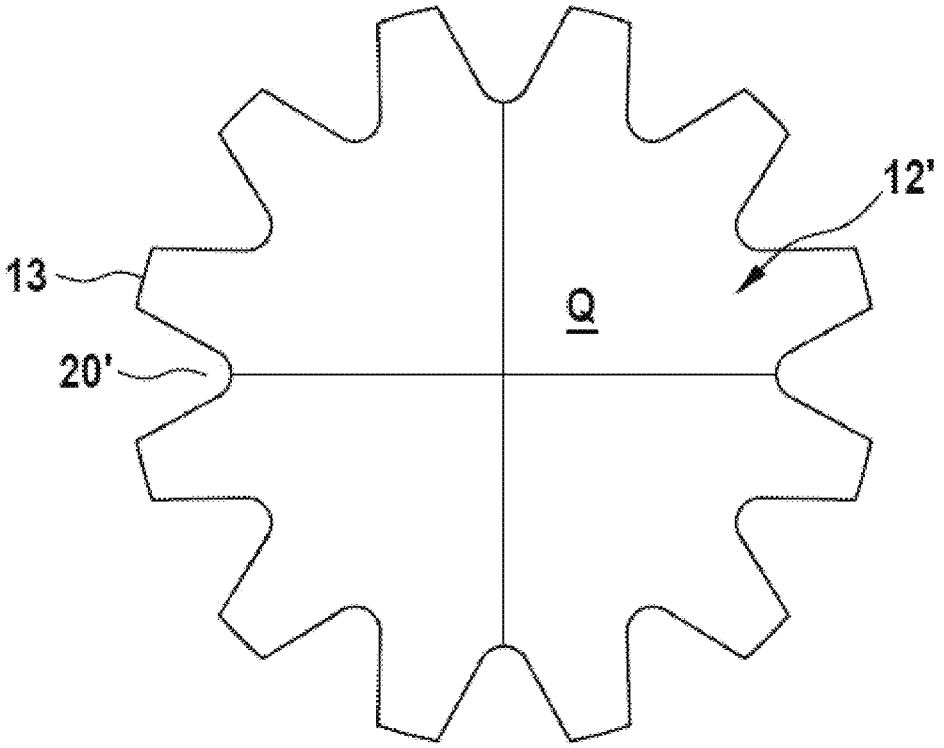
FIG. 5 is a sectional view of a partial region of a main body of a penetrator according to the invention according to a fifth embodiment.

FIG. 5 shows a sectional view of a partial region 12 with longitudinal recesses 20 of a main body 10 of a penetrator 1 according to the invention according to a fourth embodiment. The fifth embodiment is based on the first and/or second embodiment, and only the differences between the fifth embodiment and the first and/or second embodiment are set forth below.

According to FIG. 5, the partial region with longitudinal recesses comprises a plurality of longitudinal notches 20'. The number of longitudinal notches 20' can be twelve, for example, as shown in FIG. 5, but more or fewer longitudinal notches 20 can also be configured.

The longitudinal notches according to FIG. 5 are configured in a triangular shape and are rounded in the notch base.

Insofar as the foregoing disclosure relates to a penetrator 1, the disclosure applies in like manner to a projectile which is configured from such a penetrator 1, a tail unit and a sabot.

In particular, the penetrator 1 according to the invention is for use of the penetrator 1 to engage an armored target with reactive armor, in particular a tank with reactive armor.

LIST OF REFERENCE SIGNS

1 Penetrator
10 main body
12 partial region with longitudinal recesses
12' first partial region with longitudinal recesses
12' second partial region with longitudinal recesses
13 outer wall
14 third partial region
20 recesses
20' longitudinal notch
20' longitudinal grooves
H tail unit
K head
Q cross-section

What is claimed is:

1. A penetrator for a projectile, the penetrator comprising a main body having a longitudinal axis, wherein the main body comprises a first partial region with longitudinal recesses extending parallel to the longitudinal axis of the main body, and a second partial region with longitudinal recesses extending parallel to the longitudinal axis of the main body and arranged behind the first partial region with longitudinal recesses, wherein the first partial region and the second partial region are configured differently from each other with respect to at least one of the number, the shape or the length of their respective longitudinal recesses, wherein the main body further comprises a cylindrical partial region between the first partial region with longitudinal recesses and the second partial region with longitudinal recesses.

2. The penetrator according to claim 1, wherein the longitudinal recesses of the first partial region and the longitudinal recesses of the second partial region are configured in an outer wall of the main body.

3. The penetrator according to claim 1, wherein the longitudinal recesses of the first partial region or the second partial region are distributed equidistantly over the circumference of the first partial region or the second partial region.

4. The penetrator according to claim 1, wherein the at least one of the first partial region or the second partial region comprises a substantially axisymmetric cross-section.

5. The penetrator according to claim 1, wherein the longitudinal recesses of at least one of the first partial region or the second partial region are in the form of longitudinal notches.

6. The penetrator according to claim 5, wherein each of the longitudinal notches is rectangular, triangular or u-shaped.

7. The penetrator according to claim 1, wherein the longitudinal recesses of at least one of the first partial region or the second partial region are in the form of longitudinal grooves.

8. The penetrator according to claim 1, wherein the at least one of the first partial region or the second partial region is fluted.

9. The penetrator according to claim 1, wherein the first partial region comprises three longitudinal recesses.

10. The penetrator according to claim 1, wherein the main body is configured from a tungsten heavy metal.

11. The penetrator according to claim 1, wherein at least one of the first partial region or the second partial region is configured in such a way that it comprises an increased surface moment of inertia compared to an equal-area circular cross section.

12. A method of using the penetrator according to claim 1, comprising: using the penetrator to engage an armored target with reactive armor.

13. A projectile comprising a sabot, a tail unit, and the penetrator according to claim 1.

14. The penetrator according to claim 9, wherein the second partial region comprises six longitudinal recesses.

15. The penetrator according to claim 1, wherein the second partial region comprises six longitudinal recesses.

16. The penetrator according to claim 1, further comprising a head attached to the main body, wherein the first partial region is arranged between the head and the second partial region.

17. The penetrator according to claim 1, wherein the main body includes a head, and the first partial region is arranged between the head and the second partial region.

* * * * *